US006136775A

United States Patent [19]

Strout et al.

[11] Patent Number: 6,136,775

[45] Date of Patent: Oct. 24, 2000

[54] WET WIPE WITH NON-AQUEOUS, OIL-BASED SOLVENT FOR INDUSTRIAL CLEANING

[75] Inventors: Kelly Michael Strout, Roswell; Cleary Efton Mahaffey, Suwanee; Pamela Jean Mayberry, Roswell, all of Ga.

[73] Assignee: Kimberly-Clark Worldwide, Inc., Neenah, Wis.

[21] Appl. No.: 09/216,284

[22] Filed: Dec. 18, 1998

[51] Int. Cl.[7] ..... C11D 3/44; C11D 17/04

[52] U.S. Cl. ..... 510/439; 510/138; 510/174; 510/201; 510/213; 510/365; 510/406; 510/407; 510/413; 510/421; 510/437

[58] Field of Search ..... 510/439, 406, 510/407, 413, 437, 421, 138, 174, 201, 213, 365

[56] References Cited

U.S. PATENT DOCUMENTS

| | | | |
|---|---|---|---|
| Re. 31,885 | 5/1985 | Meitner | 428/156 |
| 3,277,013 | 10/1966 | Gianladis | 252/153 |
| 3,304,262 | 2/1967 | Corey | 252/122 |
| 3,666,690 | 5/1972 | Bann | 252/547 |
| 3,708,435 | 1/1973 | Starkman | 252/544 |
| 3,896,807 | 7/1975 | Buchalter | 128/261 |
| 3,965,518 | 6/1976 | Muoio | 15/104.93 |
| 4,075,375 | 2/1978 | Komatsu | 427/390 R |
| 4,117,187 | 9/1978 | Adams et al. | 428/286 |
| 4,330,422 | 5/1982 | Tesch | 134/40 |
| 4,397,754 | 8/1983 | Collishaw et al. | 252/91 |
| 4,511,488 | 4/1985 | Matta | 252/162 |
| 4,620,937 | 11/1986 | Dellutri | 252/143 |
| 4,657,691 | 4/1987 | Hara et al. | 252/91 |
| 4,659,609 | 4/1987 | Lamers et al. | 428/194 |
| 4,788,060 | 11/1988 | Endicott et al. | 424/443 |
| 5,141,803 | 8/1992 | Pregozen | 428/288 |
| 5,188,754 | 2/1993 | Weltman et al. | 252/162 |
| 5,284,703 | 2/1994 | Everhart et al. | 428/283 |
| 5,330,673 | 7/1994 | Bayless | 252/171 |
| 5,333,698 | 8/1994 | Van Slyke | 175/65 |
| 5,370,817 | 12/1994 | Weltman et al. | 252/170 |
| 5,393,451 | 2/1995 | Koetzle | 252/170 |
| 5,393,468 | 2/1995 | Erilli et al. | 252/550 |
| 5,415,787 | 5/1995 | Vlasblom | 252/8.57 |
| 5,415,789 | 5/1995 | Vlasblom et al. | 252/8.57 |
| 5,441,666 | 8/1995 | Dotolo | 252/170 |
| 5,462,690 | 10/1995 | Rhinesmith | 252/126 |
| 5,462,697 | 10/1995 | Yianakopoulos | 252/528 |
| 5,529,723 | 6/1996 | Drapier | 252/550 |
| 5,634,984 | 6/1997 | Van Slyke | 134/40 |
| 5,683,971 | 11/1997 | Rose et al. | 510/130 |
| 5,720,966 | 2/1998 | Ostendorf | 424/402 |
| 5,723,423 | 3/1998 | Van Slyke | 510/188 |
| 5,728,662 | 3/1998 | Vlasblom | 510/130 |
| 5,788,781 | 8/1998 | Van Slyke | 134/40 |
| 5,817,585 | 10/1998 | Rose et al. | 442/417 |

FOREIGN PATENT DOCUMENTS

| | | |
|---|---|---|
| 2187552 | 4/1998 | Canada . |
| 2198327 | 8/1998 | Canada . |
| 0615720A1 | 3/1994 | European Pat. Off. . |
| 0474413B1 | 6/1996 | European Pat. Off. . |
| 2538238 | 12/1982 | France . |
| WO98/24871 | 11/1997 | WIPO . |

OTHER PUBLICATIONS

Patent Abstract of JP 07–2615 to Matsuda et al. (Jan. 6, 1995).

Patent Abstract of JP 02–21834 to Yamagata et al. (Jan. 24, 1990).

Patent Abstract of DE 3144168 A1 to Ghegan (May 19, 1983).

Patent Abstract of JP 01–38018 to Araya et al. (Feb. 8, 1989).

Patent Abstract of GB 2036783A to Blumenfeld et al. (Jul. 2, 1980).

*Primary Examiner*—Lorna M. Douyon

*Attorney, Agent, or Firm*—Dority & Manning, P.A.

[57] ABSTRACT

An absorbent wipe is provided impregnated with a non-toxic, oil-based cleaning solvent comprising the polar oil d-limonene, a non-polar mineral oil, and a hydrophilic surfactant. The resulting article provides an effective wipe for removing oil-based soils such as oil, grease, tar, ink, and similar contaminants. The article provides a non-toxic wipe which is safe for use on skin, has low volatility, and provides a solvent which self-emulsifies in water. Accordingly, the solvent residue may be easily rinsed and removed from cleaned surfaces. Further, the solvent carrying the removed contaminant may be separated from the wiper to facilitate hazardous waste separation.

12 Claims, No Drawings

WET WIPE WITH NON-AQUEOUS, OIL-BASED SOLVENT FOR INDUSTRIAL CLEANING

FIELD OF THE INVENTION

The present invention is generally directed to paper wiping products. More particularly, the present invention is directed to a paper wiping product impregnated with a non-aqueous, oil-based solvent which is particularly well-suited for removing inks, paints, tar, grease, and similar industrial soils. The wipe and solvent combination is suitable for cleaning parts in tools as well as removing soil from a worker's hands and other body parts. The paper wiping product may be either a non-woven material such as a spin-bond material, a melt-blown material, or a woven fabric. The use of a non-aqueous, oil-based solvent with a paper wiping product is not heretofore available in known products.

BACKGROUND OF THE INVENTION

Disposable wiper products are widely used in both the home and in industrial shops to replace conventional cloth wipers and towels. Industrial-type cleaning needs include the removal of inks, oils, greases, paints, tar, and other oil-based materials. There is a large market of products and solvents directed towards cleaning and removing these materials from an operator as well as tools and equipment. A paper wiping product suitable for removing various industrial-type soils from a user's hands or body are available from several manufacturers. However, it is believed that conventional wiper products contain an alcohol or aqueous-based cleaning solution which work with varying degrees of success with respect to the various industrial cleaning requirements. Other products contain toxic solvents which are unsuitable for cleaning skin.

For instance, commercial printing ink used by newspapers, is one of the more tenacious soils and is particularly difficult to remove from an operator's hands. Conventional cleaning wipes are not effective in the complete removal of printing ink. Further, individuals often resort to using hazardous solvents to remove the printer's ink.

Accordingly, there remains room for improvement within the art of solvent-impregnated wipers to be used for industrial cleaning purposes.

SUMMARY OF THE INVENTION

The present invention recognizes and addresses some of the foregoing limitations and deficiencies of prior art cleaning systems.

It is a general object of the present invention to provide a disposable wiper impregnated with a non-aqueous, oil-based solvent which is effective at removing tars, greases, oils, and similar materials. Such materials have historically been difficult to remove with a disposable, pre-saturated wiper and solvent combination. The present invention provides a unique combination of a wiper/solvent, in which the solvent is compatible with a wide variety of disposable wipers as well as woven materials. The compatibility of the solvent with a broad range of different wiper types, enables a suitably heavy duty type wipe to be selected.

The objects of the present invention are achieved by providing an absorbent wiping product which may be made of multiple cellulosic web layers, or from melt-blown fibers, or from woven cellulose fibers. In each instance, the wiper is used to dispense an effective amount of a non-aqueous, oil-based solvent. Preferably, the wiper product and solvent combination are provided in a pull-out type dispenser.

DETAILED DESCRIPTION OF PREFERRED EMBODIMENT

It is to be understood by one of ordinary skill in the art that the present discussion is a description of exemplary embodiments only, and is not intended as limiting the broader aspects of the present invention, which broader aspects are embodied in the exemplary construction.

A preferred embodiment of the present invention provides a disposable wipe which is impregnated with a non-aqueous, oil-based solvent. The combination of the wiper and solvent provides a cleaning product, particularly useful for use as an industrial cleaner for materials such as inks, paints, tar, and grease (petroleum and animal derived).

An industrial type wiper is provided comprising an abrasive, cloth-like wiper having a non-aqueous cleaning composition impregnated therein comprising at least one surfactant and at least one diluent oil. In a preferred cleaning solvent formulation, the diluent oil further comprises a mixture of a terpene and a mineral oil in solution with hydrophilic surfactants.

The wipe can be provided from a number of different materials. According to a first embodiment of this invention, the towel can be similar to that described in U.S. Pat. No. 5,284,703 to Kimberly-Clark Corporation entitled "High Pulp Content Non-Woven Composite Fabric" which is herein incorporated by reference in its entirety. Such products are available from Kimberly-Clark Corporation under the Hydroknit® trademark. According to a second embodiment of this invention, a melt-blown wipe similar to that described in U.S. Pat. No. 4,659,609 to Kimberly-Clark Corporation entitled "Abrasive Web and Method of Making Same" may be employed.

Both embodiments provide a fabric web having at least one abrasive cleaning surface suitable for an industrial grade wiper and which is compatible with the preferred cleaning solvent.

As used herein, the term "abrasive" refers to a surface texture that enables the towel to produce a mild scouring or abrading action to effectively remove dirt or other contaminants. Such dirt or contaminants are frequently embedded in a surface. It is well known within the art that the degree of abrasiveness can be controlled and may vary widely depending upon the desired end use.

In both the first and the second embodiments, the wiper is capable of absorbing and retaining an effective amount of a cleaning composition so as to provide a uniformly moist wipe. The absorbent character of the wipe retains the liquid formulation by capillary action and readily releases the cleaning fluid during use. wipes with adsorbent qualities for either the cleaning solvent or the industrial oils may also be employed.

The composition of the cleaning solution formula embodied in this invention generally comprises a low volatility mixture of a surfactant in combination with a polar diluent oil such as d-limonene. In the embodiments described herein, a second diluent oil, such as non-polar mineral oil, is present along with an additional surfactant.

The cleaning composition is a useful solvent for cleaning oil-based soils. The solvent is essentially water thin which, while effective as an industrial spray cleaner, renders the composition difficult to dispense as a hand cleaner. In accordance with this invention, the combination of a wipe impregnated with the solvent cleaner has been found to offer an improved cleaning method and apparatus.

In the preferred embodiments described, the cleaning formulation of the present invention is comprised of the mixture set forth in Table 1 as weight %.

TABLE 1

| | |
|---|---|
| Flavor grade d-limonene 40% | Sweetener grade between 80 1.5% |
| Sweetener grade between 85 4.5% | Mineral oil 54% |

The cleaning solvent formula listed in the table above was provided by Union Oil Company of California d/b/a UNOCAL of El Segundo, Calif., and was selected from lot number KMS-1-97-1. This formula and other variations of the formula believed useful in the present invention, are taught in U.S. Pat. No. 5,723,423 and U.S. Pat. No. 5,634,984, both to Unocal, and which are both incorporated herein by reference. The Unocal patents describe various useful compositions and methods for cleaning oil-coated substrates using formulas similar to those set forth above. Additional formulations believed useful for this invention include the formulations recited within EPO European Patent Specification EPO 474 413 B1 and which is incorporated herein by reference.

Useful polar oils include, but are not limited to, plant oils, animal oils, terpenoids, silicon oils, and mixtures thereof. Useful non-polar oils include mineral oils, white mineral oils, paraffinic solvents, polybutylenes, polyisobutylenes, polyalphaolefins, and mixtures thereof.

While the embodiments described in the present application make use of the formula set forth in Table 1, it is believed that numerous variations of cleaning solvents as taught in the above-referenced Unocal and EPO reference would suffice. Such formulations could be selected for various needs and adjustments made to bring about changes in viscosity, varying concentrations of solvent, toxicity, surfactants, and compatibility with the fabric component of the wipe. Without undue experimentation, one having ordinary skill in the art could select from the various cleaning compositions set forth in the above-referenced publications to provide a cleaning composition compatible with a wipe and which provides a non-toxic cleaning apparatus.

The cleaning formulation used in the present invention provides an effective oil and grease remover, particularly with respect to petroleum-based soils. The cleaning composition is present as a true solution, the surfactant(s) being dispersed throughout the diluent oils. The use of hydrophilic surfactants having a high hydrophobic-lipophilic balance (HLB) value is preferred in that they have been previously shown to have the greatest cleaning ability with respect to oily contaminants. Upon contact with an industrial oil-type contaminant, the diluent oils dissolves in the contaminant and, because the surfactant(s) are dissolved in the cleaning composition, the surfactant is distributed throughout the oil. The absorbent and abrasive qualities of the wipe are used to physically apply the cleaning composition to a soiled substrate, provide abrasive action to the soil and substrate, and provide an absorbent surface for retaining the dissolved contaminant. The invention thereby provides a cleaning wipe which can be used as a single device for applying, rubbing, and removing selected soils.

As noted above in Table 1, a preferred cleaning composition includes a mixture of tween 80 and tween 85 which are both hydrophilic surfactants having a high HLB value. The surfactants enhance the cleaning ability of the resulting solution and contribute to the self-emulsifying properties exhibited by the solution upon exposure to water.

Other useful surfactants include, but are not limited to, polyoxyethylene (20) sorbitan monolaurate, polyoxyethylene (20) sorbitan monooleate, polyoxyethylene (20) sorbitan monopalmitate, polyoxyethylene (20) sorbitan trioleate, polyoxyethylene (20) sorbitan tristearate, polyoxyethylene (4) sorbitan monolaurate, polyethylene oxide (20) sorbitan monooleate, polyethylene oxide (20) sorbitan trioleate, and mixtures thereof.

The wiper of the present invention is useful in a variety of applications. The wiper is highly effective at removing oil-based soils and contaminants from an individual's skin. Further, the wipes provide a good cleaning article for oil or grease covered articles such as hard, non-porous surfaces such as metal, tile, sealed concrete, painted surfaces, food preparation utensils and surfaces, automotive parts, and tools. It is also useful at removing oil-based paints and stains from hard surfaces or scuff marks from floor surfaces.

The present invention has further utility as a stain remover or pre-treatment for fabric surfaces. The impregnated wipes can be used to blot and remove oily materials from clothing and fabric. Where immediate removal is not achieved using the wiper, the wiper effectively transfers the cleaning composition to the soil. Thereafter, the soil/solvent oil/surfactant stain will emulsify and separate upon further cleaning with water or detergent.

The wipes lend themselves to packaging in pull-out type dispensers as well as sealed single packaged wipes. By way of example, the latter can be used as promotional items or as a consumer premium which accompanies the retail sale of motor oil or an oil filter.

Further, the cleaning composition is non-toxic. In the tested formulation, the ingredients all comprise food grade quality sweeteners or oils. As a result, the product is safe and non-toxic when applied directly to human skin.

The following are examples of the wiper having the cleaning composition according to this invention. These examples are not meant in any way to limit the scope of this invention.

EXAMPLE 1

The wiper of the present invention was evaluated using a forearm cleaning test on human test volunteers. The test procedures were as follows.

A 63 $cm^2$ area test site was located on the volar forearm of both arms of test subjects. Three different Chroma meter baseline measurements were made of each test site and the resulting L values were recorded. Each test site had applied 0.25 mls of an oil-based printer's ink (Vanson Oil-Based Offset Ink, Mineola, N.Y. 11501).

The soil was allowed to dry for 15 minutes. Following drying, the test site was blotted 10 times with a Wypall® wipe (Kimberly-Clark) which is a tissue cellulose print bond dry wipe having a 52#/ream basis weight. The soiled test site then had three measurements taken with the Chroma meter and the resulting L values were recorded.

The cleaning step involves folding a single wiper into fourths and begin wiping the soiled area. The abrasive side of the wiper was passed over the soiled area 10 times in a 15-second interval, the wiper was turned over and the test area was again wiped 10 more times in a subsequent 15-second interval. The wiper is then turned inside out and an additional 10-wipe pass in 15 seconds was performed followed by turning the wiper to the unused segment and wiping the area a final 10 times in 15 seconds. In summary, each test site was wiped for a total of 40 times within a one minute interval.

The test area was allowed to dry for 10 minutes and three final Chroma meter measurements made on each site and the respective L values recorded.

The Chroma meter used in this procedure is a Minolta 300 meter have an 8 mm measuring area. The color readings which were taken are translated into the L*a*b* coordinates whose spacing correlates closely with color changes perceived by the human eye. The resulting L* values represent how light or dark a color is, higher values indicating a lighter skin tone. Use of a Chroma meter test and the resulting L values is well known in the art as reflected in the publication entitled "Quantitation of Erythema in a Soap Chamber Test Using the Minolta Chroma" as published in the *Journal for the Society of Cosmetic Chemistry*, Vol. 34, page 475–479, 1986, which is incorporated herein by reference.

The above protocol was used to evaluate the performance of a Hydroknit® wipe which is a spun bond hydrophilic non-woven wipe available from Kimberly-Clark. The Hydroknit® base sheet was loaded with 325 percent or 250 percent by weight of the cleaning formulation set forth in Table 1. For comparison, a Sanituff® (Kimberly-Clark) dual textured melt blown heavy duty cleaning wipe was evaluated. The control wipe has similar abrasive properties to the Hydroknit® wipe and is impregnated with an aqueous based cleaning solution including surfactants. The data from the two experimental wipes and the control wipe is set forth in Table 2.

As seen in Table 2, the wiper with the oil-based cleaning solvent were significantly better at removing oil-based ink than the control Sanituff® wipe. As set forth in Table 2, the percent cleaned values were calculated by taking the difference of the cleaned reading and the soiled reading for each subject divided by the difference of the initial reading and the soiled reading. The value is set forth as a percentage as seen in Table 2 as "percent cleaned". The percentages of all the test subjects were averaged and standard deviations calculated for each evaluated wipe.

Similar data (unreported) has been observed for other wipes such as the melt blown wipe described in Embodiment 2 of the current invention. It has been observed by the inventors on multiple occasions that the cleaning solvent used with various absorbent tissue products offer a vast improvement over conventional wipers with respect to oil-based soils including grease, inks, tars, and similar petroleum-based products.

TABLE 2

| Sample | % Cleaned | Standard Deviation (%) |
|---|---|---|
| Hydroknit ® with 325% | 98 | 2.74 |
| Hydroknit ® with 250% | 94 | 3.12 |
| Sanituff ® Heavy Duty Cleaning Wipe | 72 | 6.89 |

In particular, printer's ink which heretofore has proven to be the most difficult to remove of test materials, was removed more effectively by the test wipes. In evaluations of commercially available wiper products, only the test wipes of the present invention were able to remove with highest efficiency the test soil from the test volunteers.

In preparing the wipe articles of the preferred embodiments, a plurality of the abrasive wipes may be provided, preferably in a continuous, perforated roll of towels. The perforation provides a line of weakness by which the towels can be more easily separated. It is envisioned that the towels are inserted on end in a selectively resealable, preferably cylindrical, container, with the axis of the cylinder being aligned in an essentially vertical orientation. It is also possible to provide a stack of individual towels instead of a continuous roll of towels. For either format of wiper, the cleaning formula is added to the container, preferably by saturating the formula over the roll of towels. In addition, capillary action associated with the void volume of the towel holder container brings about an even distribution of the cleaner formulation throughout the roll of towels.

One example of a suitable container for holding the towels comprises an essentially air-tight lid on the top portion of the container. The lid has a hinged cap initially covering an opening positioned beneath the cap. The opening allows for the passage of towels from the interior of the sealed container whereby individual towels can be removed by grasping the towel and tearing the seam off of each roll. The opening in the lid is appropriately sized to provide sufficient pressure to remove any excess liquid from each wiper as it is removed from the container.

Once removed, the wiper contains a sufficient amount of cleaning composition to remove materials such as inks, paints, oils, tars, etc. from surfaces including an individual's skin. As the wiper is rubbed on the surface to be cleaned, it releases sufficient cleaning formula which makes contact with the contaminant. The wiper also provides an abrasive action and a reabsorption capability to remove the contaminant by the wiping action.

In the second described embodiment, the non-woven polypropylene wipe will avoid re-depositing the contaminant upon the surface which is being cleaned.

Heretofore, it has not been known to combine a non-aqueous, oil-based, surfactant-containing cleaning composition with a wiper product. Wiper products used for skin cleaning have traditionally relied upon aqueous and/or alcohol-based cleaning compositions. The present cleaning composition provides a non-toxic formulation which is ideally suited for use with a industrial-type wiper.

One advantage of the present invention is that when used for cleaning skin, the skin is left with a moisturizing residue of mineral oil and does not require any additional cleaning with soap and water. The cleaning properties are further enhanced by the presence of the d-limonene in that this ingredient has been reported to have anti-bacterial properties.

Additionally, the cleaning formulation is self-emulsifying in the presence of water. As such, it is a simple matter to remove the residue from the skin or other cleaned surfaces. Further, the presence of small amounts of water on or adjacent to the surface to be cleaned does not adversely affect the cleaning efficiency.

In addition to a useful hand cleaning wipe, the combination of the wipe and cleaning formulation is useful for cleaning similar industrial contaminants from a variety of hard surfaces such as tools and work environment surfaces. The present invention is particularly well adapted for cleaning metal parts and tools in that a thin film of mineral oil will remain following cleaning and serve to protect the metal from surface oxidation.

In the presence of water, the surfactant emulsifies the diluent oils along with any contaminant dispersed within the cleaning composition. As a result, a water external emulsion is formed. The water external emulsion is readily removed from a cleaned surface or the wipe upon rinsing with water. The present invention offers advantages in terms of reducing and concentrating hazardous waste stream environments. Many industrial soils are classified as hazardous materials. As a result, saturated wipes and rags used to clean or remove these materials are themselves contaminated and are added to the hazardous waste disposal stream. A small quantity of water or an aqueous cleaner will emulsify the cleaning solution and entrained contaminants, thereby removing the contaminants from the wipe. As a result, the wipe may be removed from the hazardous waste stream for recycling or disposal purposes.

The present invention offers numerous advantages over typical cleaning products for industrial contaminants. To the extent that wipe-based cleaners have been used, such wipes typically employ hazardous or volatile solvents and chemical agents which are unsafe for skin cleansing needs and which expose an unprotected user to the hazardous solvent. Applicant's present invention provides a useful cleaning wipe which may be handled safely by the user, uses a solvent which is pleasantly scented, is non-toxic, and, even if misused or misapplied, poses little or no risk to the end user. Further, the wiper product has proven to be far more effective at removing stubborn industrial contaminants than any other cleaning formulation suitable for use as a hand wipe.

Although desired embodiment of the invention has been described using specific terms, devices, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. An article for removing oil-based soils comprising:

an absorptive substrate having two opposed surfaces;

a cleaning composition for removing oil-based materials and impregnating said substrate, said cleaning composition consisting of:

a first diluent oil selected from the group of polar oils consisting of plant oils, animal oils, terpenoids, silicon oils, and mixtures thereof;

a second diluent oil selected from the group of non-polar oils consisting of mineral oils, white mineral oils, paraffinic solvents, polybutylenes, polyisobutylenes, polyalphaolefins, and mixtures thereof, said first diluent oil and the second diluent oil collectively comprising 94% by weight of the cleaning composition;

a first hydrophilic surfactant soluble in at least one of said first and said second diluent oils; and, a second hydrophilic surfactant soluble in at least one of said first and said second diluent oils.

2. The article according to claim 1, wherein said first diluent oil is a terpene.

3. The article according to claim 1, wherein the first diluent oil is d-limonene.

4. The article according to claim 1, wherein said second diluent oil is a mineral oil.

5. The article according to claim 4, wherein said mineral oil is present at a weight % greater than the first diluent oil.

6. The article according to claim 4 wherein the mineral oil is present in an amount of 54 percent by weight of the cleaning composition.

7. The article of claim 1 where the first and second surfactants are selected from the group consisting of poly-oxyethylene (20) sorbitan monolaurate, poly-oxyethylene (20) sorbitan monooleate, polyoxyethylene (20) sorbitan monopalmitate, polyoxyethylene (20) sorbitan trioleate, polyoxyethylene (20) sorbitan tristearate, and polyoxyethylene (4) sorbitan monolaurate.

8. The article according to claim 1 wherein the first diluent oil is d-limonene and the second diluent oil is a mineral oil and the first hydrophilic surfactant is polyethylene oxide (20) sorbitan monooleate and the second hydrophilic surfactant is polyethylene oxide (20) sorbitan trioleate.

9. The article according to claim 1 wherein the cleaning composition is present in an amount from 250% to 325% by weight of said substrate.

10. The article according to claim 1, wherein said absorptive substrate is provided by a non-woven cellulose material.

11. The article according to claim 1, wherein said absorptive substrate is provided by a web comprising melt blown fibers.

12. The article according to claim 1, wherein said absorptive substrate comprises a woven fabric.

* * * * *